United States Patent [19]

Inada et al.

[11] 4,169,489

[45] Oct. 2, 1979

[54] FLUID FLOW CONTROL VALVE MECHANISM

[75] Inventors: Masami Inada; Takeharu Ohumi, both of Kariya, Japan

[73] Assignee: Aisin Seiki Kabushiki Kaisha, Kariya, Japan

[21] Appl. No.: 819,916

[22] Filed: Jul. 28, 1977

[30] Foreign Application Priority Data

Aug. 3, 1976 [JP] Japan ..... 51-103624[U]

[51] Int. Cl.[2] ..... E03B 7/07

[52] U.S. Cl. ..... 137/545; 137/549; 137/625.3; 251/206; 251/325; 251/61.5; 123/117 A

[58] Field of Search ..... 123/117 A; 251/205, 251/206, 325, 61.5; 137/545, 549, 625.3

[56] References Cited

U.S. PATENT DOCUMENTS

| | | | |
|---|---|---|---|
| 907,609 | 12/1908 | Kirk | 251/205 |
| 922,060 | 9/1908 | Stockdon | 251/205 |
| 2,635,620 | 4/1953 | Deardorff | 137/549 |
| 3,317,183 | 5/1967 | Szwargulski | 251/120 |
| 3,321,173 | 5/1967 | Seger | 251/61.5 |
| 3,493,217 | 2/1970 | Farley | 261/39 |
| 3,853,146 | 12/1974 | Blair | 137/625.3 |
| 3,902,696 | 9/1975 | Ito et al. | 251/61.5 |
| 3,996,955 | 12/1976 | Kawabata | 123/117 A |
| 4,010,721 | 3/1977 | Ludwig | 123/117 A |
| 4,041,982 | 8/1977 | Lindner | 137/625.3 |

FOREIGN PATENT DOCUMENTS

| | | | |
|---|---|---|---|
| 499690 | 5/1930 | Fed. Rep. of Germany | 137/545 |

*Primary Examiner*—William R. Cline
*Assistant Examiner*—H. Jay Spiegel
*Attorney, Agent, or Firm*—Sughrue, Rothwell, Mion, Zinn and Macpeak

[57] ABSTRACT

A control valve is provided with an inlet and outlet port and a variable flow control arrangement therebetween. The variable flow control arrangement is comprised of a hollow spool member having a plurality of orifices disposed in a spiral manner along the length of the spool and a sleeve having an annular valve member in contact with the spool movable axially of the spool to selectively expose one or more orifices to a valve chamber in communication with the outlet port. The sleeve member is connected to a flexible diaphragm having a first surface exposed to an atmospheric pressure chamber within the control valve and a second surface exposed to a signal vacuum chamber adapted to be connected to a vacuum supply. Spring means are provided in the signal vacuum chamber for normally biasing the sleeve into a position covering all of the orifices in the absence of a vacuum signal within the signal vacuum chamber.

6 Claims, 4 Drawing Figures

FLUID FLOW CONTROL VALVE MECHANISM

BACKGROUND OF THE INVENTION

1. Field of the Invention

This invention relates broadly to a fluid flow control valve mechanism and more specifically to a valve mechanism for controlling the vacuum signal to a spark advance mechanism.

2. Prior Art

In order to control the quantity of fluid flow between inlet and outlet ports, conventional valve mechanisms include a valve member of the needle type which variably controls the fluid communication between the inlet and outlet ports in proportion to a control signal. Such a needle valve member has a valve surface which is adapted to be spaced from a valve seat so that the quantity of fluid flow is controlled in proportion to the spacing between the needle valve and seat.

In prior mechanisms, however, it is quite difficult to accurately set the spacing to control a very small quantity of fluid flow. Small particles of foreign matter can readily prevent the accurate spacing control of the needle valve.

SUMMARY OF THE INVENTION

Therefore, it is an object of the present invention to provide an improved fluid flow control valve mechanism which obviates prior drawbacks mentioned above.

It is another object of the present invention to provide an improved fluid flow control valve mechanism which can control a very small quantity of fluid flow in a very accurate manner.

It is still another object of the present invention to provide an improved fluid flow control valve mechanism of the above type which is simple in construction.

The foregoing and other objects, features and advantages of the invention will be apparent from the following more particular description of preferred embodiments of the invention as illustrated in the accompanying drawings.

DETAILED DESCRIPTION OF THE INVENTION

Figure 1:
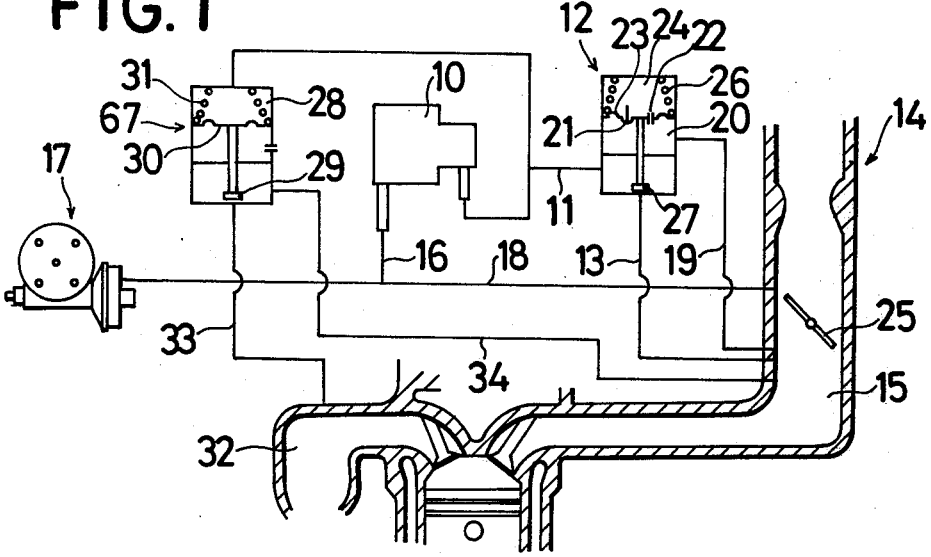
FIG. 1 is a schematic view showing an exhaust gas emission control system having a fluid flow control valve mechanism according to the present invention therein.

Referring to FIG. 1, a fluid flow control valve mechanism 10 according to the present invention is arranged within an exhaust gas emission control system.

The control valve mechanism 10 is fluidly connected to an intake manifold 15 downstream of the carburetor 14 by means of a conduit 11, a vacuum control valve means 12 and a conduit 13, and also is fluidly connected to a conduit 18 via a conduit 16, the conduit 18 being arranged so as to establish fluid communication between a port of the carburetor 14 at which vacuum is produced in response to the degree of opening of a throttle valve 25 and a distributor 17.

The vacuum control valve means 12 has a first chamber 20 which receives vacuum from the intake manifold 15 via conduit 19. The first chamber 20 is isolated from a second chamber 24 by means of a diaphragm member 23 having a check valve 21 and an orifice 22 therein. Thus, when the throttle valve 25 is moved in the opening direction from its closed position so as to decrease the degree of vacuum at the intake manifold 15, the check valve 21 is maintained in its closed position for a predetermined period by means of fluid pressure differences between chambers 20 and 24 and the valve member 27 movable with the diagphragm 23 will be in its open position against the biasing force of a spring 26. After the predetermined period, fluid pressure within the chamber 24 will become the same as that within the chamber 20 due to the arrangement of the orifice 22, and the valve 27 will be urged by the spring 26, to its closed position wherein communication between the conduits 11 and 13 is interrupted.

During the period fluid communication is established between the conduits 11 and 13, the control valve mechanism 10 receives vacuum pressure at the intake manifold 15 so that the valve mechanism 10 can operate to bleed air into the conduits 16 and 18, as will be clear hereinafter.

The conduit 18 is part of a conventional engine spark timing control system, and the distributor 17 is urged in its spark timing retarded direction when air is bled into the conduit 18. As will be apparent from the previous discussion, air will be bled into the conduit 18 only during the above predetermined period when valve 27 is open. Thereafter, the conduit 18 will only receive vacuum pressure in response to the degree of opening of the throttle valve 25 so that the distributor 17 will be urged in its spark timing advanced direction in the conventional manner.

The conduit 11 is also connected to a vacuum chamber 28 of an exhaust gas recirculation control valve means 67 whereby a diaphragm member 30 with a valve member 29 secured thereto is moved upwardly against a spring 31 to open fluid communication between conduits 33 and 34. The conduit 33 is connected to an exhaust manifold 32 while the conduit 34 is connected to the intake manifold 15. Thus a part of exhaust gas within the exhaust manifold 32 is recirculated into the intake manifold 15 when the valve 29 is in its open position in the conventional manner.

Figure 2:
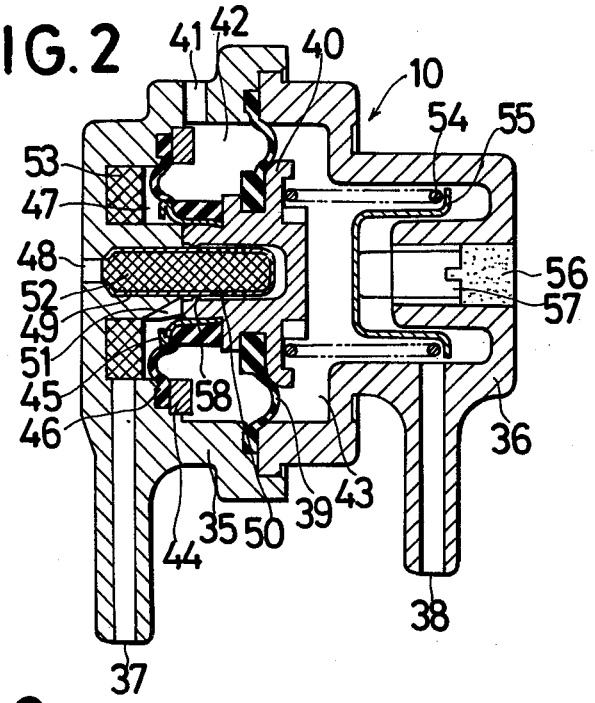
FIG. 2 is a cross-sectional view showing the fluid flow control valve mechanism.

Turning to FIG. 2, the fluid flow control valve mechanism 10 according to the present invention comprises first and second bodies 35 and 36 secured to each other, the first body 35 having an outlet port 37 adapted to be connected to the conduit 16 and the second body 36 having a signal inlet port 38 adapted to be connected to the conduit 11. A first diaphragm member 39 has its outer periphery secured between the bodies 35 and 36 and its inner periphery secured to a movable member 40 thereby defining a first atmospheric pressure chamber 42 and a signal vacuum chamber 43. The atmospheric pressure chamber 42 is exposed to the atmosphere through a hole 41 formed in the body 35. Within the first body 35, a control or secnd atmospheric chamber 47 is defined by a second diaphragm member 46 the outer periphery of which is secured between a stationary member 44 secured to the body 35 and the body 35, and the inner periphery of which is secured to a supporting member 45 secured to the movable member 40.

The second atmospheric chamber 47 is adapted to be connected to the conduit 16 by means of the outlet port 37.

The second atmospheric chamber 47 is adapted to receive atmospheric air through an inlet port 48 formed in the body 35, a plurality of orifices 50 formed in a hollow spool member 49 securely supported in a passage 51 formed in an inward extension of the body 35. A first filter means 52 is disposed within the spool 49 while a second filter means 53 is disposed within the second atmospheric chamber. The first filter means 52 may trap relatively large foreign particles in the fluid flow and the second filter means 53 may remove relatively small foreign particles.

The movable member 40 is normally maintained by a spring 54 in its nonoperating illustrated position wherein all orifices 50 are closed by an annular valve portion 58 provided on the movable member 40. The other end of the spring 54 is seated against a retainer 55. The retainer 55 is adjustably positioned by a screw means 57 which is threaded through the second body 36 and sealed by means of a silicon rubber member 56 having a sealing function. Thus, the biasing force of the spring 54 may be adjusted.

Figure 3:
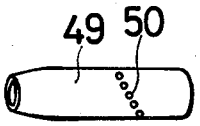
FIG. 3 is a perspective view showing a spool of the control valve mechanism.
Figure 4:
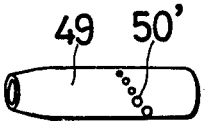
FIG. 4 is a view similar to FIG. 3 but showing another embodiment thereof.

A plurality of orifices 50 are spirally provided on the spool 49, as shown in FIG. 3. Therefore, orifices 50 are arranged to be opened in order as the movable member 40 is moved toward the right in FIG. 2. In addition, orifices 50' may be formed as shown in FIG. 4 in which the effective diameters of orifices 50' are increased in order so that, first of all, the orifice 50' having minimum diameter is opened by the initial movement of the movable member 40 and thereafter orifices 50' having larger diameters are opened in order in accordnce with rightward movement of the movable member 40.

Due to the spiral arrangement of orifices 50 or 50' a large number of orifices may be opened by the relative short stroke of the movable member 40 so that the axial length of control valve mechanism 10 may be reduced.

When the signal chamber 43 receives the vacuum pressure at the intake manifold 15, the biasing force of the spring 54 is overcome and the movable member 40 is urged to be moved toward the right in FIG. 2. The variable position of the movable member 40 is in response to the degree of vacuum pressure within the signal chamber 43. Assuming that the degree of signal vacuum pressure corresponds to the force by which movable member 40 is displaced so as to open only the leftmost orifice 50 on the spool 49, a very small quantity of air controlled by the effective diameter of the leftmost orifice 50 is bled from the port 48 into the outlet port 37 and then into conduits 16 and 18. As the degree of signal vacuum pressure increases, the nmber of orifices 50 to be opened (or the number of variable diameter orifices 50' as shown in FIG. 4) increased so that the quantity of bled air will be increased. Thus the engine spark timing is controlled very accurately. During the above conditions, the exhaust gas recirculation valve means 67 will receive the same signal vacuum pressure so as to accomplish exhaust gas recirculation.

When the signal chamber 43 receives no signal vacuum pressure through the vacuum control valve means 12, the parts of the control valve mechanism 10 are positioned in the non-operating illustrated positions of FIG. 2 so that no air is bled.

While the invention has been particularly shown and described with reference to preferred embodiments thereof it will be understood by those in the art that various changes in form and details may be made therein without departing from the spirit and scope of the invention.

What is claimed is:

1. A fluid flow control valve mechanism comprising a body having inlet, outlet and signal ports, moveable means disposed within said body comprising a moveable valve member and a pair of spaced apart annular diaphragms, the inner peripheries of said diaphragms being connected directly to said moveable valve member and the outer peripheries of said diaphragms being connected to said body respectively, said body and one of said diaphragms defining a signal chamber in communication with said signal port, said body and the other of said diaphragms defining a control chamber in communication with said inlet and outlet ports, additional port means connecting the chamber defined intermediate said diaphragms with the atmosphere, a hollow elongated cylindrical spool member disposed within said control chamber with the interior thereof in communication with said inlet port and having a plurality of orifices disposed along the length thereof, said moveable valve member having a blind bore in which said spool member is received and an annular valve portion adjacent the open end of said blind bore extending radially into said bore in sliding contact with said spool for controlling communication between the inlet port and outlet port through the apertured spool member and control chamber and biasing means biasing said moveable member against a signal pressure in said signal chamber.

2. A control valve mechanism as set forth in claim 1, wherein said orifices are spirally formed on said spool member along the length thereof.

3. A control valve mechanism as set forth in claim 1, wherein the first of said orifices which is opened by the initial movement of said movable member has a minimum effective diameter with the effective diameters of the remaining orifices increasing in sequential order.

4. A control valve mechanism as set forth in claim 1, wherein said biasing means is comprised of a coil spring bearing against said movable member at one end and an adjustably mounted retaining member engaging the opposite end of said spring for varying the spring force.

5. A fluid flow control valve mechanism comprising a body having inlet, outlet and signal ports, moveable means disposed within said body comprising a moveable member and a pair of spaced apart annular diaphragms, the inner peripheries of said diaphragms being connected to said moveable member and the outer peripheries of said diaphragms being connected to said body respectively, said body in one of said diaphragms defining a signal chamber in communication with said signal port, said body and the other of said diaphragms defining a control chamber in communication with said inlet and outlet ports, additional port means connecting the chamber defined intermediate said diaphragms with the atmosphere, a hollow elongated cylindrical spool member disposed within said control chamber with the interior thereof in communication with said inlet port and having a plurality of orifices disposed along the length thereof, said moveable member having a blind bore in which said spool member is received and an annular valve portion located in said bore for controlling communication between the inlet port and outlet port through the apertured spool member and control chamber, biasing means biasing said moveable member against a signal pressure in said signal chamber, first filtering means disposed within said hollow spool member and second filtering means disposed in said control chamber in front of said outlet port.

6. A control valve mechanism as set forth in claim 5, wherein said second filtering means is designed to filter smaller particles than said first filtering means.

* * * * *